US006065551A

United States Patent [19]

Gourley et al.

[11] Patent Number: 6,065,551

[45] Date of Patent: May 23, 2000

[54] METHOD AND APPARATUS FOR ROTARY MINING

[75] Inventors: Allen James Gourley; Larry Parks Gourley, both of New Bethlehem, Pa.

[73] Assignee: G & G Gas, Inc., New Bethlehem, Pa.

[21] Appl. No.: 09/062,493

[22] Filed: Apr. 17, 1998

[51] Int. Cl.[7] ..... F21B 7/30

[52] U.S. Cl. ..... 175/291; 175/53; 175/19

[58] Field of Search ..... 175/53, 19, 291, 175/266; 299/15, 20, 21, 39.3

[56] References Cited

U.S. PATENT DOCUMENTS

| | | | |
|---|---|---|---|
| 1,423,625 | 7/1922 | Rogers | 175/291 |
| 3,236,320 | 2/1966 | Russ | 175/291 |
| 3,343,614 | 9/1967 | Parisien | 175/19 |
| 3,472,553 | 10/1969 | Miller . | |

FOREIGN PATENT DOCUMENTS

| | | |
|---|---|---|
| 2 575 776 | 1/1985 | France . |
| 544 182 | 1/1932 | Germany . |
| 1 381 575 | 1/1975 | United Kingdom . |
| 1 416 624 | 12/1975 | United Kingdom . |
| 1 427 528 | 3/1976 | United Kingdom . |

*Primary Examiner*—William Neuder
*Assistant Examiner*—Zakiya Walker
*Attorney, Agent, or Firm*—Kirkpatrick & Lockhart LLP

[57] ABSTRACT

The present invention is directed to a rotary mining apparatus. The apparatus includes an elongated housing with a leading end and an opposite trailing end. The apparatus also includes a compression device coupled to the housing. The apparatus further includes a plurality of cables extending along the housing. Each of the cables has an end connected to the compression device. The apparatus also includes a plurality of cutting devices attached to the cables at ends of the cables opposite the ends connected to the compression device. The present invention is also directed to a method of removing subterranean material. The method includes the step of inserting a rotary mining device having radially extendable cutting devices into a subterranean shaft. The method also includes the steps of rotating the mining device such that the cutting devices contact the sides of the shaft and extending the cutting devices into the sides of the shaft.

25 Claims, 8 Drawing Sheets

METHOD AND APPARATUS FOR ROTARY MINING

I. CROSS REFERENCE TO RELATED APPLICATIONS (Not Applicable)

II. STATEMENT REGARDING FEDERALLY SPONSORED RESEARCH OR DEVELOPMENT (Not Applicable)

III. BACKGROUND OF THE INVENTION

1. Field of the Invention

The present invention is directed generally to a method and apparatus for mining, and, more particularly, to a method and apparatus for rotary mining.

2. Description of the Background

In conventional mining, different techniques are employed to remove the desired subterranean material. One technique that is commonly employed for mining coal from seams that are relatively deep beneath the surface involves a network of underground shafts and passages. Sophisticated and expensive mining machinery loosens the material and transports the material to the surface, but personnel are required to work with them in dangerous underground conditions.

Another technique, known as strip or surface mining, is used to remove valuable material from seams that are relatively close to the surface. In strip mining, dirt, rocks, gravel, etc., referred to as overburden, are removed above a coal seam to expose the seam. However, strip mining also requires the use of expensive machinery to remove the overburden and the material. Furthermore, because the overburden is removed above the seam, strip mining has an adverse environmental impact on the area being mined and returning a strip mine site to its original condition can be costly. Strip mining also has the disadvantage that it may not be economically feasible to remove the overburden above deep portions of a seam that varies in depth. Such a situation may dictate the use of expensive highwall mining techniques that are designed to remove the material from the deep portion of a seam when removal of overburden is no longer economically feasible. In this technique, a mining apparatus is placed on a bench in the strip mine and mining and conveying apparatuses are propelled into the seam in parallel entries. Thus, there is a need for a method and apparatus to remove relatively shallow subterranean material, such as coal from a coal seam, without having to remove the overburden from atop the material and without having to employ expensive machinery.

IV. SUMMARY OF THE INVENTION

The present invention is directed to a rotary mining apparatus. The apparatus includes an elongated housing with a leading end and an opposite trailing end. The apparatus also includes a compression device coupled to the housing. The apparatus further includes a plurality of cables extending along the housing. Each of the cables has an end connected to the compression device. The apparatus also includes a plurality of cutting devices attached to the cables at ends of the cables opposite the ends connected to the compression device.

In the present invention, a shaft is bored into the earth and the rotary mining device is inserted into the shaft. The mining device is rotated such that the cutting devices attached to the cables contact the sides of the shaft and loosen the material to be removed. As the material is removed, centrifugal force forces the cables and cutting devices outward such that the cutting devices are in constant contact with the sides of the shaft. Compressed air may be introduced through the mining device to evacuate the loosened material from the shaft.

The present invention represents a substantial advance over prior systems and methods for mining. The present invention has the advantage that it can remove subterranean material relatively quickly without jeopardizing human safety underground. The present invention has the further advantage that it is capable of removing material from thin seams which often contain valuable materials which cannot otherwise be mined cost effectively. The present invention also has the advantage that it can be used for special applications such as to remove material from edges, corners, and EPA sensitive seams. The present invention also has the advantage that mined material can be continuously loaded as it is mined. The present invention has the further advantage that excavated cylinders from which material has been mined can be used for waste disposal. The present invention also has the advantage that oil and gas can be won by creating large diameter disks in "pay zones."

These advantages, and other advantages and benefits of the present invention, will become apparent from the Detailed Description of the Invention hereinbelow.

V. BRIEF DESCRIPTION OF THE DRAWINGS

For the present invention to be understood and readily practiced, the present invention will be described in conjunction with the following figures, wherein.

VI. DETAILED DESCRIPTION OF THE INVENTION

Figure 1:
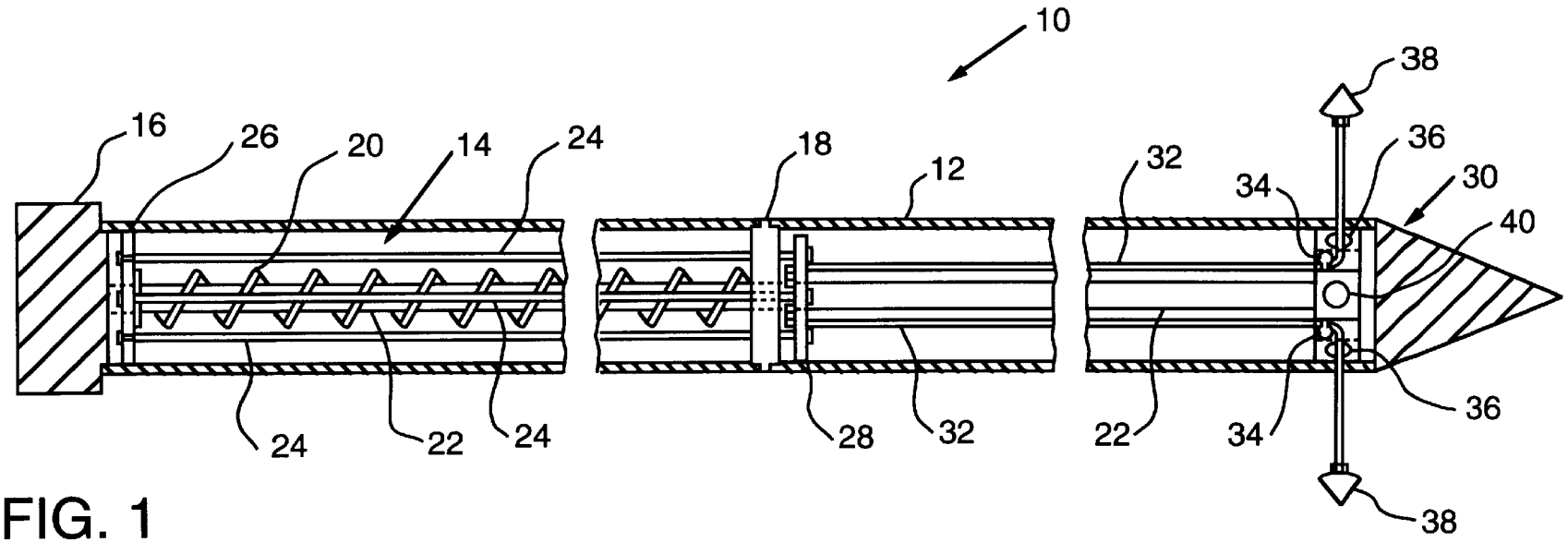
FIG. 1 is a cross-sectional illustration of a rotary mining device according to a preferred embodiment of the present invention.

FIG. 1 is a cross-sectional illustration of a preferred embodiment of a rotary mining device 10. The device 10 includes an elongated cylindrical housing 12 which is constructed of a durable material such as, for example, steel. The housing 12 includes a compression chamber 14 which is sealed at one end by a damper cap 16 and at the other end by a damper base 18. The compression chamber 14 also includes a spring 20 which is coiled around an air shaft 22. The air shaft 22 is connected to the damper cap 16. A plurality of drop rods 24 are connected to a top disk 26 at an end of the housing 12 closest to the damper cap 16. The drop rods 24 extend through the damper base 18 and are connected to a bottom disk 28. The damper base 18 has openings which allow the drop rods 24 to extend through the damper base 18 while sealing the compression chamber 14.

The air shaft 22 extends through the damper base 18 and the bottom disk 28 and is connected to a spin tip assembly 30. The spin tip assembly 30 is depicted in the preferred embodiment shown in FIG. 1 as having a conical shape. However, it will be understood by those skilled in the art that the spin tip assembly 30 can be of any shape as is practical and may have cutting surfaces attached thereto. Also, the spin tip assembly 30 is constructed of a durable material such as, for example, steel or cemented tungsten carbide.

Cables 32 are connected to the bottom disk 28 and extend around pulleys 34 and through holes 36 in the spin tip assembly 30. The holes 36 correspond with openings in the housing 12 which allow the cables 32 to pass through the housing 12. It can be understood by those skilled in the art that the cables 32 can be constructed of any durable material which retains strength under tension such as, for example, stranded steel or woven Dupont Kevlar® brand fiber. Also, the cables 32 can be of a semi-rigid nature by constructing them of, for example, a unidirectional chain. Cutting devices 38 are connected to the ends of the cables 32 which are extended through the holes 36. It can be understood by those skilled in the art that the cutting devices 38 may be, for example, standard cutting tools or bits used in the mining industry or may be of a type as described in conjunction with FIGS. 3 and 9 hereinbelow. Air holes 40 extend from the air shaft 22 through the spin tip assembly 30 and through the housing 12. Although the preferred embodiment as shown in FIG. 1 has three cables 32 and three cutting devices 38, it can be understood by those skilled in the art that other numbers of cables 32 and cutting devices 38 may be included in the device 10.

Figure 2:
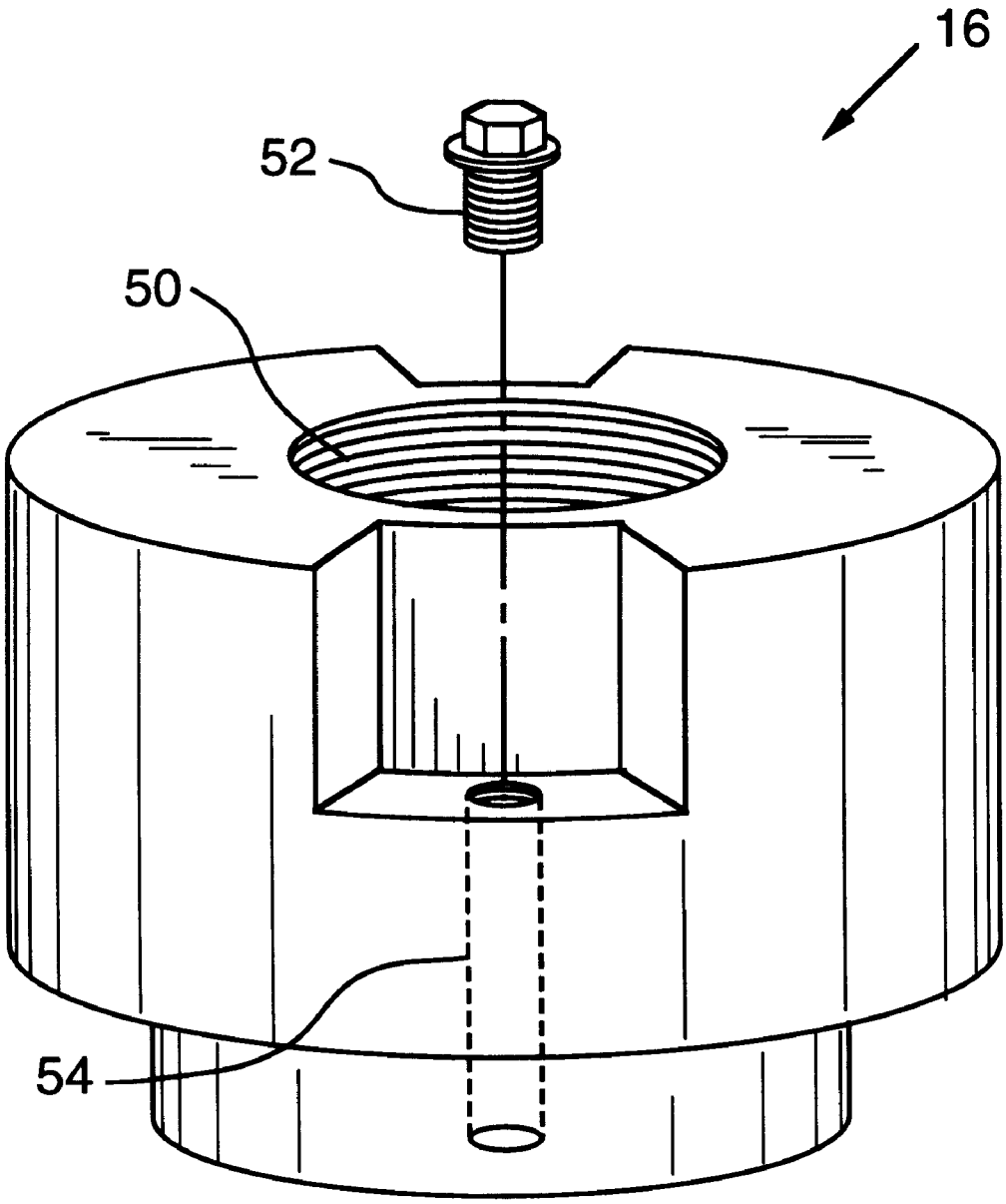
FIG. 2 is an illustration of a preferred embodiment of the damper cap of FIG. 1.

FIG. 2 illustrates a preferred embodiment of the damper cap 16 of FIG. 1. The damper cap 16 contains a threaded portion 50 which accepts the air shaft 22. The damper cap 16 also has a drain screw 52 which threads into a fill and drain hole 54. The fill and drain hole 54 is used to fill or drain the compression chamber 14 with a viscous fluid. The drain screw 52 prevents fluid leakage from the compression chamber 14 while facilitating the draining and filling of the compression chamber 14.

Figure 3:
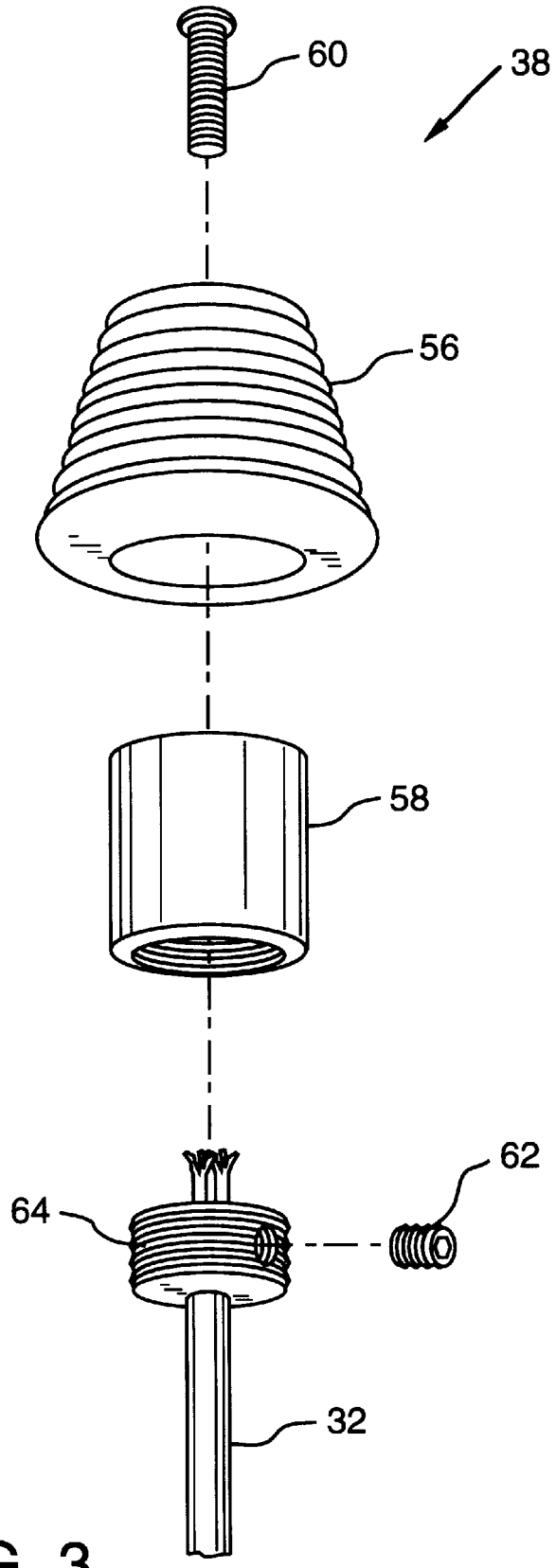
FIG. 3 is an illustration of a preferred embodiment of the cutting device of FIG. 1.

FIG. 3 illustrates a preferred embodiment of the cutting devices 38 of FIG. 1. A cutting tip 56 is secured to a midsection 58 by a fastener 60. It can be understood by those skilled in the art that the cutting tip 56 may be constructed of any material suitable for cutting hard surfaces such as, for example, cemented tungsten carbide. A second fastener 62 secures the cable 32 to a threaded collar 64. It can be understood by those skilled in the art that the fasteners 60 and 62 may be any type of fastener such as, for example a bolt, or a screw. The collar 64 is threaded onto the midsection 58. Such an arrangement facilitates ease of replacement of the cutting tip 56 if it becomes worn or exceeds its useful life.

Figure 4:
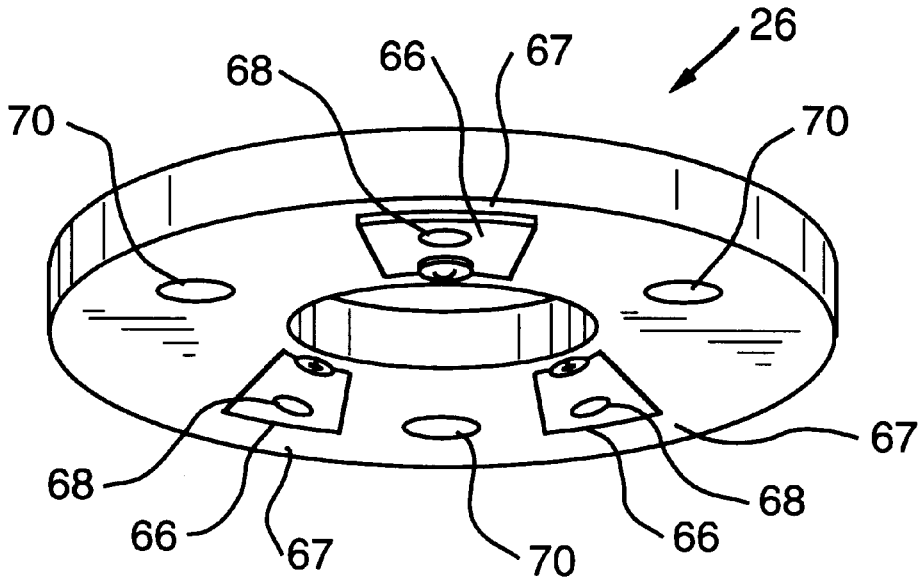
FIG. 4 is an illustration of a preferred embodiment of the top disk of FIG. 1.

FIG. 4 illustrates a preferred embodiment of the top disk 26 of FIG. 1. The top disk 26 acts as a damper. The top disk 26 has check valves 67 having flaps 66 and holes 68 which allow the top disk 26 to move more freely in the direction of the damper cap 16 than in the direction of the spin tip assembly 30 by allowing less fluid (liquid or air) in the compression chamber 14 to flow past the top disk 26 when the cables 32 are being extended and by allowing more fluid (liquid or air) in the compression chamber 14 to flow past the top disk 26 when the cables 32 are being retracted. Thus, the check valves 67 affect the amount of force that must be overcome by the centrifugal force of the spinning cables 32 and cutting devices 38 to pull the top disk 26 through the compression chamber 14, but allows the top disk 26, and hence the cables 32, to be rapidly retracted when their centrifugal force is abated. It can be understood by those skilled in the art that the top disk 26 may be provided without the check valves 67 and an alternative arrangement can be used. For example, the flaps 66 can be constructed of a flexible material, such as, for example, spring steel or a flexible polymer, that allows the flaps 66 to open when the top disk 26 is moving in a direction toward the damper cap 16 and allows the flaps 66 to remain substantially closed when the top disk 26 is moving in a direction toward the spin tip assembly 30. Holes 70 accept the ends of the drop rods 24 therethrough.

Figure 5:
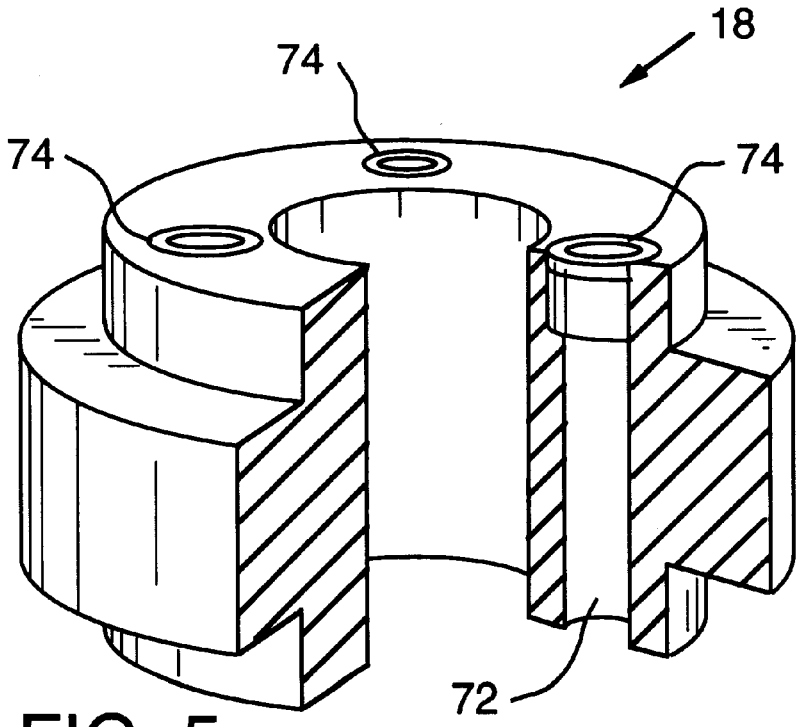
FIG. 5 is an illustration of a cut-away view of a preferred embodiment of the damper base of FIG. 1.

FIG. 5 illustrates a cut-away view of a preferred embodiment of the damper base 18 of FIG. 1. The damper base 18 has passages 72 which allow the drop rods 24 to exit the compression chamber 14 as the cables 32 are extended outside the housing 12 and the bottom disk is forced toward the spin tip assembly 30. The passages 72 are fitted with seals 74 that prevent the viscous fluid, if one is present, from leaking out of the compression chamber 14. It can be understood by those skilled in the art that the seals 74 can be of any type of seal suitable for allowing the drop rods 24 to pass through the passages 72 while preventing fluids from escaping from the compression chamber 14. Such seals could be, for example, PolyPak seals, PTFE fluid power seals, or U packing seals.

Figure 6:
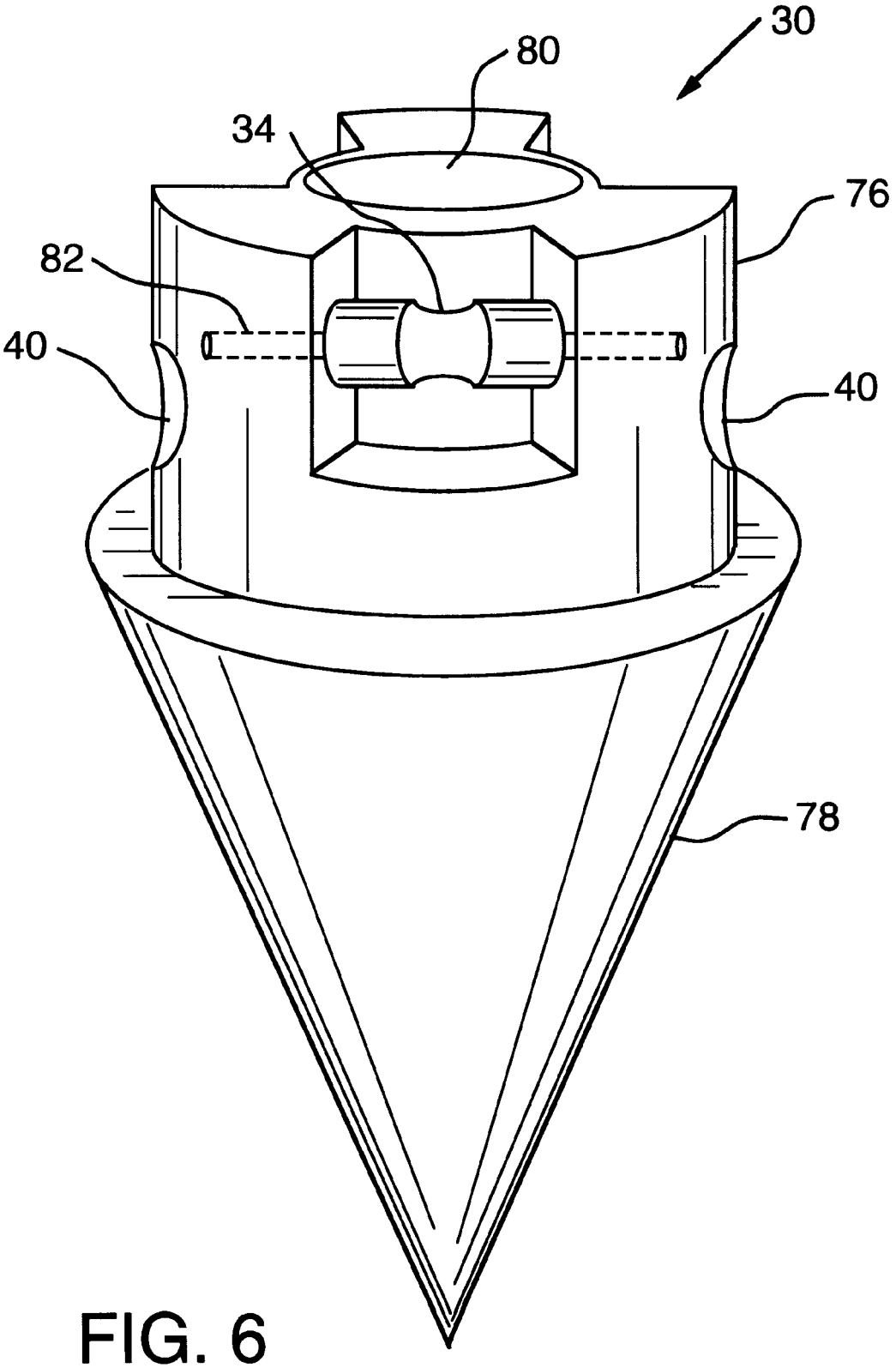
FIG. 6 is an illustration of a preferred embodiment of the spin tip of FIG. 1.

FIG. 6 illustrates a preferred embodiment of the spin tip assembly 30 of FIG. 1. The spin tip assembly 30 includes an insert section 76 and a conical section 78, each manufactured from, for example, cemented tungsten carbide or steel. The assembly 30 includes an aperture 80 which accepts the air shaft 22 and is continuous with the holes 40 such that air traveling through the air shaft 22 exits the assembly 30 at the holes 40. The pulleys 34 are mounted on axles 82 and can rotate about the axles 82 when the cables 32 are extended or retracted.

Figure 7:
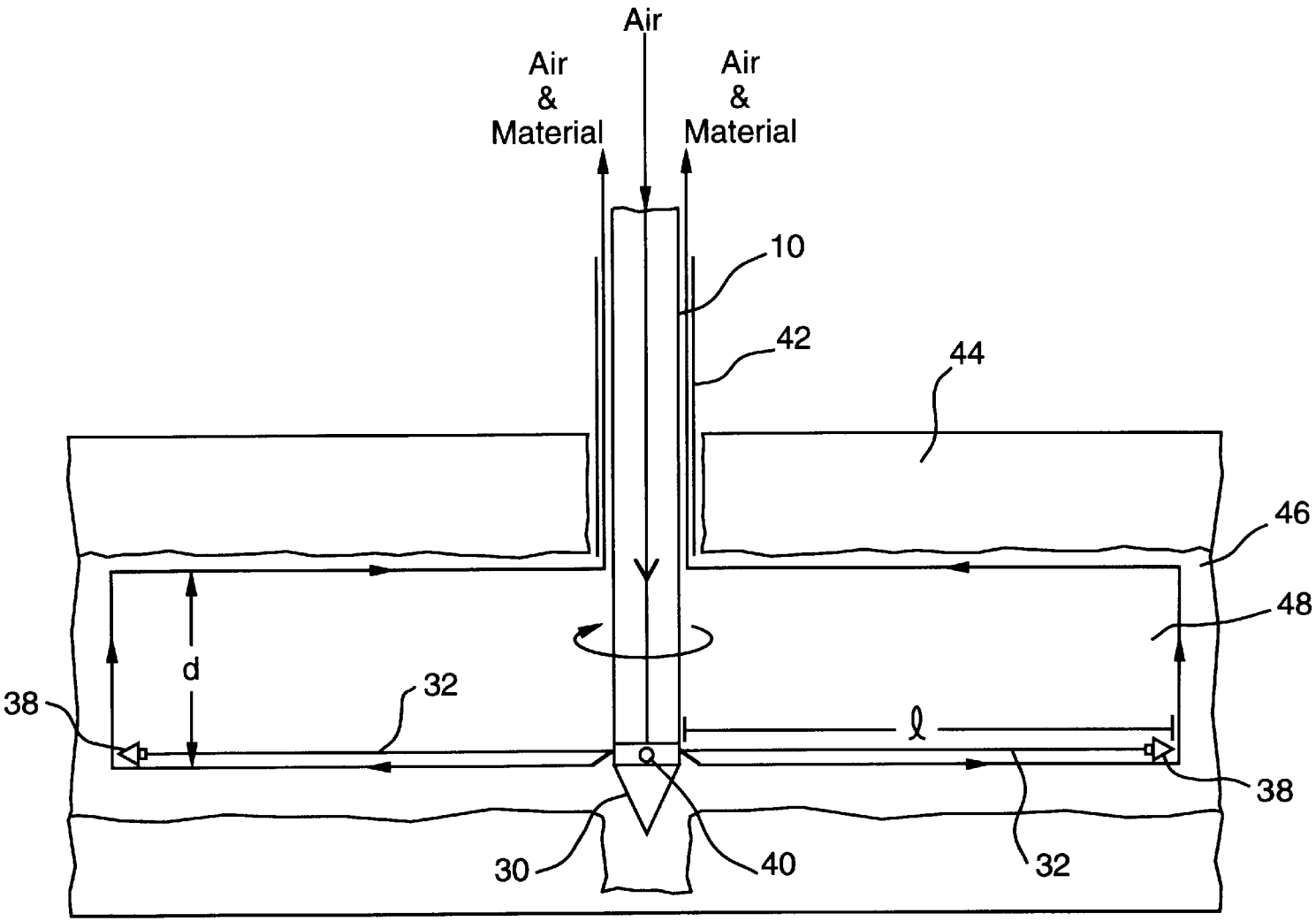
FIG. 7 is an illustration of the operation of the device of FIG. 1.

FIG. 7 illustrates the operation of the device 10 of FIG. 1. Only certain elements of the device 10 necessary to understand the principle of operation of the device 10 are illustrated in FIG. 7 for purposes of clarity. As shown in FIG. 7, a shaft is bored into the earth and a sheath 42 is placed into the shaft. The sheath 42 can be constructed of any durable material that is suited for receiving the device 10 such as, for example, steel pipe. The sheath 42 extends beneath overburden 44 and into the area of a seam 46.

When the device 10 is initially placed in the shaft, the cables 32 are in a retracted position and the top disk 26 is at an end of the compression chamber 14 closest to the damper cap 16. The spring 20 is in an extended position and holds the top disk 26 at the end of the compression chamber 14 closest to the damper cap 16. The device 10 is then lowered to a cutting location by the drill stem of a drilling rig. As the device 10 is rotated using a the drilling rig, the cutting devices 38 cut into the seam 46 and remove material from the walls of the seam 46. It can be understood by those skilled in the art that the device 10 can be rotated using a motor such as, for example, an electric or a hydraulic motor, that is placed in the shaft and attached to the housing 12 to rotate the device 10. Also, the device 10 can be rotated using a pneumatic drive system.

As the material is removed, centrifugal force forces the cutting devices 38 radially outward. When the cutting devices 38 move outward from the housing 12, tension on the cables 32 forces the bottom disk 28 toward the spin tip assembly 30. The top disk 26 is also forced in a direction toward the spin tip assembly 30. Tension on the spring 20 determines the force that must be overcome by the centrifugal force created by the spinning cutting devices 38. The amount of force that must be overcome by the spinning cutting devices 38 may also be regulated by filling the compression chamber 14 with fluids of varying viscosities such as, for example, water, hydraulic fluid, air or motor oil. The amount of force that must be overcome by the spinning cutting devices 38 may also be regulated by adjusting the check valves 67 on the top disk 26.

The size of material which exits the cavity 48 through the sheath 42 can be controlled by the shape of the cutting devices 38 and the shape of any teeth, if present, on the cutting devices 38 The size of material evacuated can also be controlled by the speed at which the cutting devices 38 and the cables 32 are extended, which is directly related to the type of fluid present in the compression chamber 14 and the velocity with which the device 10 is rotated. The device 10 can be rotated at, for example, 200 rpm to 1,700 rpm. The depth of the cavity 48 as shown in FIG. 7 is indicated as d. The width of the cavity 48 is 2l+2r, where 1 is the extended length of one cable 32 which extends beyond the housing 12 plus the length of one cutting device 38 and r is the radius of the housing 12.

When the cables 32 have reached their maximum extensions, the velocity of rotation of the device 10 is slowed or stopped. The centrifugal force is thus reduced and the spring 20 returns to an extended position and retracts the cables 32 relatively quickly in relation to the rate of extension of the cables 32. The device 10 can then be lowered or raised further into or out of the shaft and can be rotated at another location to remove more material.

During the cutting process, compressed air is introduced into the device 10 through the damper cap 16 and into the air shaft 22. Compressed air is introduced into the device 10 at, for example, pressures ranging from 400 psi to 1500 psi. The air exits the air holes 40 in the spin tip assembly 30. The direction of air flow is indicated by the arrows in FIG. 7. The air exits the air holes 40 and, due to the fan effect of the spinning cables 32 and the cutting devices 38, follows along the bottom of a cavity 48 which is formed in the seam 46 as material is removed. The air flow then picks up material that is cut from the sides of the seam 46. Because the air and material will take the path of least resistance, the air and material will continue along the sides of the cavity 48 and follow along the top of the cavity 48 until it exits through the sheath 42. It can be understood by those skilled in the art that materials other than compressed air such as, for example liquid nitrogen, may be used to aid evacuation of the material from the cavity.

At the exit from the shaft, the won material can be collected by placing a boot or a hood on the sheath 42. The material is then piped to a central collection point or into a vehicle using, for example, a network of pressurized pipes or conveyors.

Figure 8:
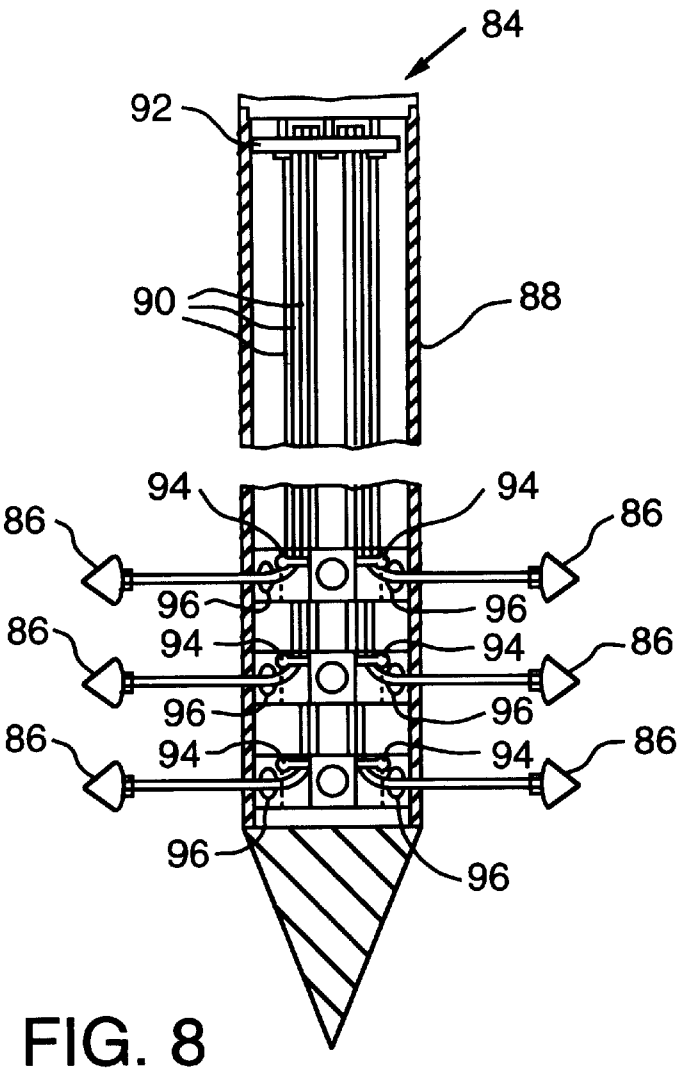
FIG. 8 is an illustration of a portion of another preferred embodiment of a rotary mining device.
Figure 10:
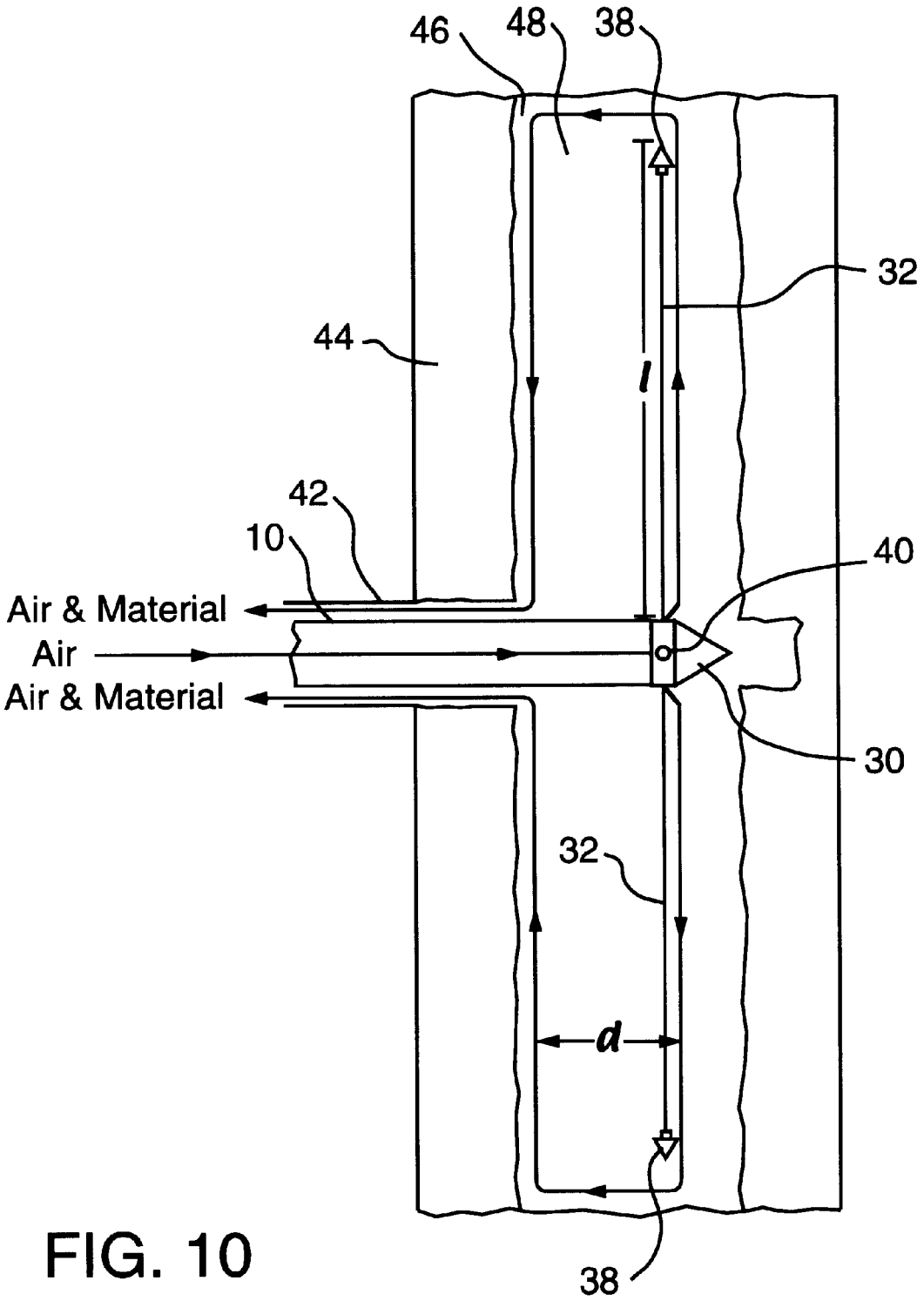

FIG. 8 illustrates a portion of another preferred embodiment of a rotary mining device 84. The device 84 has a plurality of cutting devices 86 located at intervals along housing 88. Each of the cutting devices 86 is connected to one of cables 90. One end of each cable 90 is connected to a bottom disk 92. The cables 90 extend around pulleys 94 and through holes 96 in the housing 88. The operation of the device 84 is substantially similar to the operation of the device 10 as described herein in conjunction with FIG. 7, but provides for material removal from a broader depth than if a single plane of cutters 38 were employed.

Figure 9:
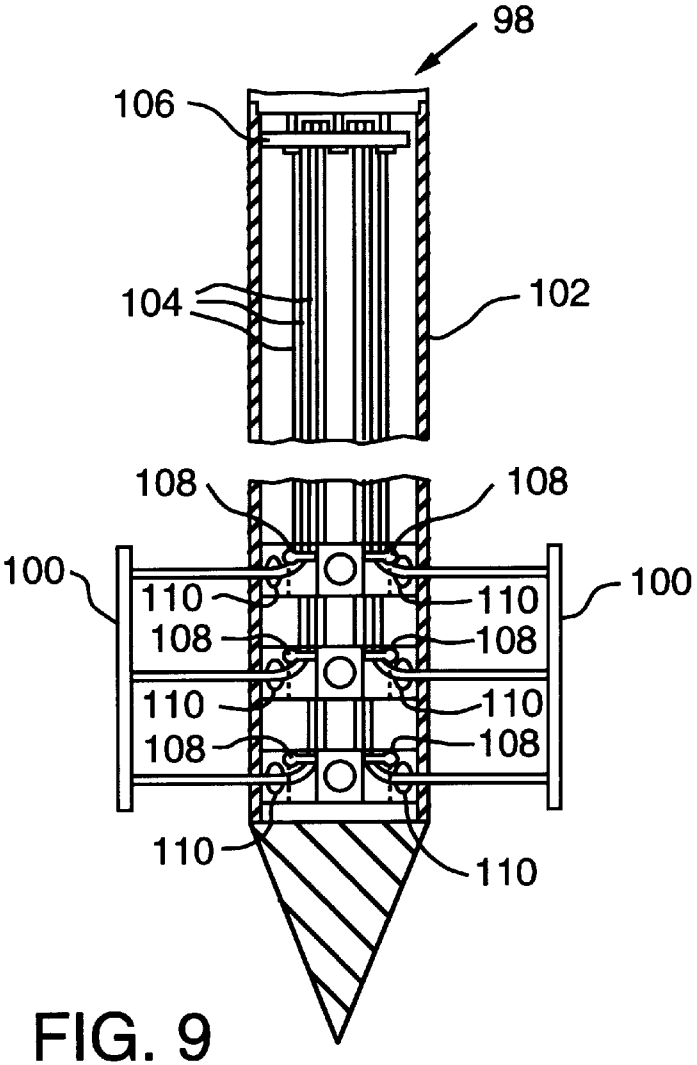
FIG. 9 is an illustration of a portion of another preferred embodiment of a rotary mining device, and, FIG. 10 shows the rotary mining device of the invention operating in a horizontal orientation.

FIG. 9 illustrates a portion of another preferred embodiment of a rotary mining device 98. The device 98 has elongated cutting devices 100 which extend continuously along a portion of housing 102. The cutting devices 100 are connected to a plurality of cables 104. One end of each cable 104 is connected to a bottom disk 106. The cables 104 extend around pulleys 108 and through holes 110 in the housing 102. The operation of the device 98 is substantially similar to the operation of the device 10 as described herein in conjunction with FIG. 7 and, again, provide for removal of a greater depth of material.

While the present invention has been described in conjunction with preferred embodiments thereof, many modifications and variations will be apparent to those of ordinary skill in the art. For example, a movable cutting head may be incorporated into the device which is capable of moving up and down the length of the housing to loosen the material in the cavity in multiple planes. Also, the angle of the cutting devices 100 may be altered or different length cables provided in the devices 84 to cut a non-cylindrical area in the cavity. Such an angled cutting arrangement can aid in air flow for facilitating evacuation of the material from the cavity. Furthermore, the use of the device is not limited to vertical shafts but may also include use in horizontal passages such as those needed for a highwall mining situation. The foregoing description and the following claims are intended to cover all such modifications and variations.

What is claimed is:

1. A rotary mining apparatus, comprising:

an elongated housing having a leading end and an opposite trailing end;

a compression device located within and coupled to said housing;

a plurality of cables extending along said housing, each of said cables having an end connected to said compression device; and a plurality of cutting devices attached to said cables at ends of said cables opposite said ends connected to said compression device.

2. The apparatus of claim 1 wherein said housing includes a spin tip assembly located at said leading end, said spin tip assembly having a plurality of apertures.

3. The apparatus of claim 2 wherein said housing has a plurality of air holes located adjacent to said apertures and wherein said spin tip assembly includes a plurality of air holes corresponding to said air holes in said housing.

4. The apparatus of claim 2 wherein said spin tip assembly includes a plurality of pulley assemblies, said pulley assemblies located in said housing and corresponding to said apertures, and wherein each of said pulley assemblies accepts one of said cables and aligns said cable with one of said apertures.

5. The apparatus of claim 2 wherein said housing includes a plurality of pulley assemblies, said pulley assemblies corresponding to said apertures, and wherein each of said pulley assemblies accepts one of said cables and aligns said cable with one of said apertures.

6. The apparatus of claim 2 wherein each of said cables includes a unidirectional chain.

7. The apparatus of claim 1 wherein said cables are located at more than one position along the length of said housing.

8. The apparatus of claim 1 wherein each of said cutting devices is attached to a plurality of said cables.

9. The apparatus of claim 8 wherein each of said cutting devices extend continuously along a portion of said housing.

10. The apparatus of claim 1 wherein each of said cutting devices is attached to one of said cables.

11. The apparatus of claim 1 wherein said compression device includes:

a compression chamber located in said housing;

an air shaft extending between each end of said housing;

a spring coiled around said air shaft and extending between each end of said compression chamber;

a damper cap closing an end of said compression chamber and closing an end of said housing;

a damper base located at an end of said compression chamber opposite said damper cap;

a top disk located at said end of said compression chamber adjacent said damper cap when said spring is in an extended position;

a bottom disk located adjacent said damper base when said spring is in the extended position, wherein said cables are connected to said bottom disk; and a plurality of drop rods connecting said top disk to said bottom disk.

12. The apparatus of claim 1 wherein each of said cutting devices includes:

a cutting tip;

a midsection connected to said cutting tip; and a threaded collar connected to said midsection and said cable.

13. The apparatus of claim 1 wherein said housing is configured to be disposed substantially vertically in use.

14. The apparatus of claim 1 wherein said housing is configured to be disposed substantially horizontally in use.

15. A rotary mining apparatus, comprising:

an elongated housing having a leading end and an opposite trailing end, said housing having a spin tip assembly located at said leading end, said spin tip assembly having a plurality of apertures, said housing having a plurality of air holes located adjacent to said apertures, and wherein said spin tip assembly includes a plurality of air holes corresponding to said air holes in said housing and a plurality of pulley assemblies, said pulley assemblies located in said housing and corresponding to said apertures;

a compression device coupled to said housing, said compression device including:

a compression chamber located in said housing;

an air shaft extending between each end of said housing;

a spring coiled around said air shaft and extending between each end of said compression chamber;

a damper cap closing an end of said compression chamber and closing an end of said housing at an end of said housing opposite said end having said apertures;

a damper base located at an end of said compression chamber opposite said damper cap;

a top disk located at said end of said compression chamber adjacent said damper cap when said spring is in an extended position;

a bottom disk located adjacent said damper base when said spring is in the extended position, wherein said cables are connected to said bottom disk; and a plurality of drop rods connecting said top disk to said bottom disk;

a plurality of cables extending along said housing, each of said cables having an end connected to said compression device, wherein each of said pulley assemblies accepts one of said cables and aligns said cable with one of said apertures; and a plurality of cutting devices attached to said cables at ends of said cables opposite said ends connected to said compression device.

16. A method of removing subterranean material, comprising the steps of:

inserting a rotary mining device into a subterranean shaft, said device comprising:

a housing having a leading end and an opposite trailing end;

a compression device located within and coupled to said housing;

a plurality of cables extending along said housing, each of said cables having an end connected to said compression device; and a cutting device attached to each of said cables at an end of said cables opposite said end connected to said compression device; and rotating said mining device such that said cutting devices contact the sides of said shaft, thereby loosening the material.

17. The method of claim 16 further comprising the step of introducing air into the housing of the device and into said shaft to facilitate evacuation of the material.

18. The method of claim 16 further comprising the step of boring a hole in the ground to form the shaft.

19. The method of claim 16 wherein said shaft is substantially vertical.

20. The met hod of claim 16 wherein said shaft is substantially horizontal.

21. A method of removing subterranean material, comprising the steps of:

inserting a rotating mining device having a housing into a subterranean shaft, said device having a plurality of radially extendable cable supported cutting devices;

rotating said mining device such that said cutting devices contact the sides of said shaft; and radially extending said cables from the housing such that said cutting devices cut into the sides of said shaft.

22. The method of claim 21 further comprising the step of introducing air into said shaft to facilitate evacuation of the material.

23. The method of claim 21 further comprising the step of boring a hole in the ground to form the shaft.

24. The method of claim 21 wherein said shaft is substantially vertical.

25. The method of claim 21 wherein said shaft is substantially horizontal.

* * * * *